US011257339B2

(12) United States Patent
Yae

(10) Patent No.: US 11,257,339 B2
(45) Date of Patent: Feb. 22, 2022

(54) APPARATUS FOR MANAGING ARTICLE FOR VEHICLE AND METHOD THEREOF

(71) Applicants: Hyundai Motor Company, Seoul (KR); Kia Motors Corporation, Seoul (KR)

(72) Inventor: Seong Soo Yae, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/985,694

(22) Filed: Aug. 5, 2020

(65) Prior Publication Data

US 2021/0312776 A1 Oct. 7, 2021

(30) Foreign Application Priority Data

Apr. 7, 2020 (KR) ..... 10-2020-0042293

(51) Int. Cl.
*G08B 13/24* (2006.01)
*G08B 21/24* (2006.01)

(52) U.S. Cl.
CPC ..... *G08B 13/2485* (2013.01); *G08B 13/2462* (2013.01); *G08B 21/24* (2013.01)

(58) Field of Classification Search
CPC ..... G08B 13/2485
See application file for complete search history.

(56) References Cited

U.S. PATENT DOCUMENTS

| | | | | |
|---|---|---|---|---|
| 7,187,278 | B2 * | 3/2007 | Biffar | G07C 9/28 340/539.13 |
| 2019/0279488 | A1 * | 9/2019 | Sasaki | G08B 21/24 |
| 2020/0286362 | A1 * | 9/2020 | Wright | G06N 20/00 |

* cited by examiner

*Primary Examiner* — Travis R Hunnings
(74) *Attorney, Agent, or Firm* — Mintz Levin Cohn Ferris Glovsky and Popeo, P.C.; Peter F. Corless

(57) ABSTRACT

An apparatus for managing an article for a vehicle and a method thereof are provided to register various articles to which an ID tag is attached and which are provided from a user. The user is notified as to whether an article corresponding to a user situation is mounted on the vehicle to improve user convenience for various activities associated with a vehicle. The apparatus includes an input device that receives information about an article to which an ID tag is attached from a user and a communicator that communicates with an ID tag attached to the article. A controller manages the article to which the ID tag is attached and provides a notification to a user as to whether an article corresponding to a user situation is mounted on the vehicle.

18 Claims, 4 Drawing Sheets

APPARATUS FOR MANAGING ARTICLE FOR VEHICLE AND METHOD THEREOF

CROSS-REFERENCE TO RELATED APPLICATION

This application claims the benefit of priority to Korean Patent Application No. 10-2020-0042293, filed on Apr. 7, 2020, the entire contents of which are incorporated herein by reference.

TECHNICAL FIELD

The present disclosure relates to a technology for managing whether various articles registered by a user are mounted on a vehicle.

BACKGROUND

In general, vehicles are used not only for commuting, but also for club activities (e.g., table tennis, soccer, swimming, and the like) and leisure activities (e.g., camping, fishing, and the like). For a user to enjoy various club activities, exercise equipment (e.g., clothes, hats, shoes, rackets, and the like) suitable for that is necessary, and camping supplies (e.g., tents, kitchen tables, relaxation chairs, hammocks, and the like) are required. Users often leave the necessary supplies at home while going to a meeting, or often forgot to bring some camping supplies while camping.

Accordingly, there is required a technology that manages the articles (e.g., personal goods, office supplies, sports goods, leisure goods, and the like) registered by a user and informs the user whether an article corresponding to a user situation is mounted on the vehicle. As a conventional technology, there is a technology that warns the user when the user leaves a mobile phone within a vehicle, but this technology is limited to a mobile phone or similar and has technical limitations in expanding to various articles of a user, and does not consider a specific situation of a user.

The matters described in this background section are merely intended to promote an understanding of the background of the disclosure and may include matters that are not already known to those of ordinary skill in in the art.

SUMMARY

The present disclosure provides an apparatus for managing an article for a vehicle and a method thereof capable of registering various articles (e.g., personal articles, office supplies, sports goods, leisure goods, and the like) to which ID tags are attached and which are provided from a user, and informing the user of whether an article corresponding to a user situation is mounted on the vehicle, thereby maximizing user convenience for various activities associated with a vehicle.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, an apparatus for managing an article for a vehicle may include an input device configured to receive information regarding the article to which an ID tag is attached from a user, a communicator configured to communicate with the ID tag attached to the article, and a controller configured to manage the article to which the ID tag is attached. The controller may be configured to inform a user as to whether an article corresponding to a user situation is mounted on the vehicle.

The controller may be configured to generate an article registration table in which at least one of an ID of the article, an article name, a receiving strength of the article measured at a reference location in the vehicle, and whether the article is mounted in the vehicle is recorded. The controller may be configured to monitor whether each article is mounted on the vehicle through the communicator to update the article registration table. Additionally, the controller may be configured to generate an article management table in which the article to which the ID tag is attached and which is registered by the user is classified into a category. In particular, the category may include a destination of the vehicle and time.

The controller may be configured to determine whether articles corresponding to a destination of the vehicle are mounted on the vehicle and inform the user of an article that is not mounted on the vehicle when the destination of the vehicle is set. The controller may be configured to identify a location of the article in the vehicle and inform a user of the identified location in the vehicle when a request for the location of the article in the vehicle is received from the user via the input device. In addition, the controller may be configured to identify a location of the article in the vehicle and inform a portable terminal of the user of the identified location in the vehicle when a request for the location of the article in the vehicle is received from the portable terminal of the user.

The controller may be configured to determine that the article is stolen and inform a portable terminal of the user of article theft when a location of the article in the vehicle is changed while the vehicle is parked. The controller may be configured to separately manage a fixed article of which a location in the vehicle is prohibited from being changed and inform the user of a location change of the fixed article when the location of the fixed article in the vehicle is changed. Further, the controller may be configured to provide a guide to set up a destination that corresponds to a purpose of a previously registered article in response to identifying that the previously registered article is mounted on the vehicle. The controller may be configured to determine whether an article corresponding to a destination is mounted on the vehicle and provide information regarding a determination result to a portable terminal of the user in response to receiving a setting of a vehicle destination from the portable terminal of the user. The article may include at least one of personal articles, office supplies, sports goods, and leisure articles.

According to another aspect of the present disclosure, a method of managing an article for a vehicle may include receiving, by an input device, information regarding an article to which an identification (ID) tag is attached from a user, communicating, by a communicator with the ID tag attached to the article, and managing, by a controller, the article to which the ID tag is attached. The managing of the article includes informing a user of whether an article corresponding to a user situation is mounted on the vehicle.

The method may include determining whether articles corresponding to a destination of the vehicle are mounted on the vehicle, and informing the user of information regarding an article that is not mounted on the vehicle. The method may further include identifying a location of the article in the vehicle when a request for the location of the article in the vehicle is received from a portable terminal of the user, and informing the portable terminal of the user of the identified location in the vehicle.

The method may further include determining a location change of the article in the vehicle while the vehicle is parked, and determining that the article is stolen and providing a notification to a portable terminal of the user indicative of the article theft. The method may further include separately managing a fixed article of which a location in the vehicle is prohibited from being changed, and informing the user of a location change of the fixed article when the location of the fixed article in the vehicle is changed. Additionally, the method may include receiving a setting of a vehicle destination from a portable terminal of the user, grasping whether an article corresponding to the destination is mounted on the vehicle, and providing grasped information to the portable terminal of the user.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
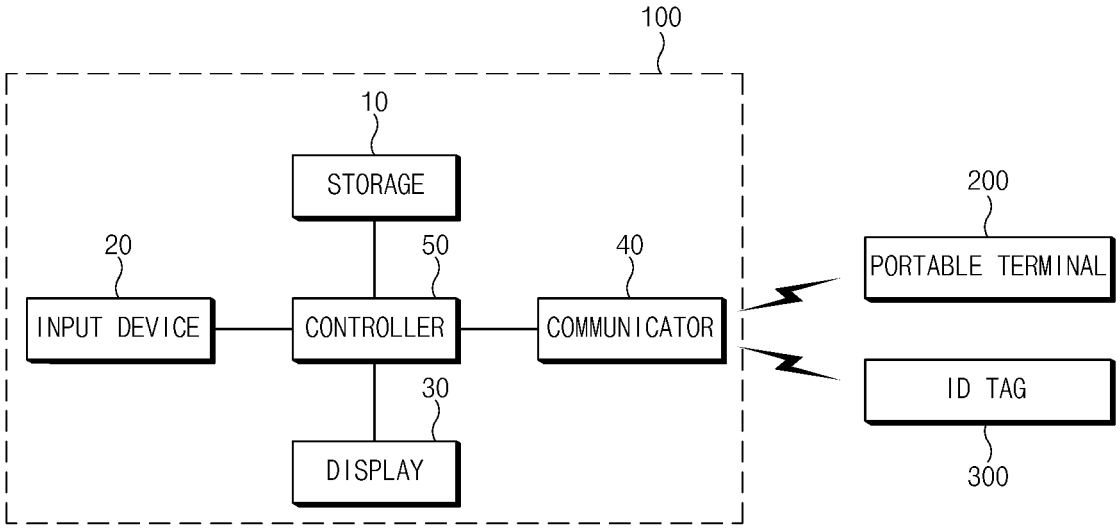
FIG. 1 is a block diagram illustrating a configuration of an apparatus for managing an article for a vehicle according to an exemplary embodiment of the present disclosure.

It is understood that the term "vehicle" or "vehicular" or other similar term as used herein is inclusive of motor vehicles in general such as passenger automobiles including sports utility vehicles (SUV), buses, bucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the exemplary embodiment of the present disclosure, a detailed description of well-known features or functions will be ruled out in order not to unnecessarily obscure the gist of the present disclosure.

In describing the components of the exemplary embodiment according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

FIG. 1 is a block diagram illustrating a configuration of an apparatus for managing an article for a vehicle according to an exemplary embodiment of the present disclosure. As shown in FIG. 1, an apparatus 100 for managing an article for a vehicle according to an exemplary embodiment of the present disclosure may include storage 10, an input device 20, a display 30, a communicator 40, and a controller 50. In particular, according to a scheme of implementing the apparatus 100 for managing an article for a vehicle according to an exemplary embodiment of the present disclosure, each component may be combined with each other to be implemented as one, and some components may be omitted.

Regarding each component, first, the storage 10 may be configured to store various logic, algorithms and programs required in the processes of registering, by a user, various articles (e.g., personal articles, office supplies, sports goods, leisure goods, and the like) to which ID tags are attached, and informing the user whether an article corresponding to a user situation is mounted on a vehicle.

The storage 100 may be configured to store an article registration table in which an identification (ID) of the article registered by the user, an article name, a receiving strength, a reference location in the vehicle, and the like. The article registration table is shown in following Table 1.

TABLE 1

| ID | Article name | Receiving strength | Reference location in vehicle | Mounted or not |
|---|---|---|---|---|
| 0001 | Eldest daughter bag | −54 dBm | Front seat | ○ |
| 0002 | Swimming bag | −64 dBm | Rear seat | ○ |
| 0003 | iPad ® | −35 dBm | Glove box | ○ |
| 0004 | Fire extinguisher | −75 dBm | Trunk | ○ |
| 0200 | Smartphone | −24 dBm | Wireless charging pad | X |

In Table 1, the receiving strength represents the signal strength measured by the communicator 40 in the state where an ID tag 300 is located at a reference location in the vehicle. For example, when ID 0001 is located at a front seat, the receiving strength of ID 0001 measured by the communicator 40 is −54 dBm. In addition, field "mounted or not" is a field indicating whether a registered article is mounted, where "O" indicates that an article is mounted and "X" indicates that an article is not mounted. Table 1 shows only a few examples to help understanding, and the number of articles does not affect the embodiment as a designer's option.

In addition, the storage 10 may be configured to store an article management table in which the articles registered by the user are classified into categories. The article management table is shown in following Table 2 as an example.

TABLE 2

| Category | Name | Article ID |
|---|---|---|
| Destination | Swimming pool | 0002 |
| | High school | 0001 |
| | Workplace | 0006(Briefcase), 0003, 0008(Suit carrier), etc. |
| | Campground | 0003, 0010(Camping bag), 0011(Hammock), 0012(Kitchen table), 0013(Brazier), 0014(Tent), 0015(Relax chair), etc. |
| Time | Business trip | 0020(Business notebook), 0003(iPad), 0030(MacBook Pro), etc. |

In Table 2, the destination represents a destination set in a navigation system of the vehicle, and the time may include a business trip, a meeting, and the like at time set by the user. Table 2 shows only a few examples to help understanding, and the number of articles does not affect the embodiment as a designer's option.

The storage 10 may include at least one type of a storage medium of memories of a flash memory type, a hard disk type, a micro type, a card type (e.g., a secure digital (SD) card or an extreme digital (XD) card), and the like, and a random access memory (RAM), a static RAM (SRAM), a read-only memory (ROM), a programmable ROM (PROM), an electrically erasable PROM (EEPROM), a magnetic memory (MRAM), a magnetic disk, and an optical disk type memory.

As one exemplary embodiment of the present disclosure, a scheme in which the storage 10 stores both the article registration table and the article management table has been described, but another exemplary embodiment may be implemented in a scheme in which an article registration database for storing the article registration table and an article management database for storing the article management table are provided, respectively.

The input device 20 may be configured to register various articles (e.g., personal articles, office supplies, sports goods, leisure goods, and the like) to which the ID tag 300 is attached from a user. In other words, the input device 20 may be configured to receive various information required to generate the article registration table and the article management table from a user. The input device 20 may be configured to receive an article name corresponding to the ID tag 300 from a user in an operation of registering the article to which the ID tag 300 is attached. In particular, the user should place the article to which the ID tag 300 is attached at a reference location in the vehicle. This is to record the receiving strength in the article registration table.

The input device 20 may be configured to receive an article ID for each category from a user. In other words, the user may select an article ID for each category. Particularly, the same article may be included in different categories repeatedly. The input device 20 may have a voice recognition function, and may be configured to receive the name of the article to which the ID tag 300 is attached by voice. For example, message "Where's the swimming bag?" may be received.

The display 30 may include a cluster of a vehicle, a head unit, a head up display (HUD), and the like, and may be configured to provide various information to a user. The display 30 may be configured to inform the user (e.g., provide a notification to a user) of a case where an article corresponding to a category is not mounted on the vehicle. For example, when the destination of the vehicle is set to a swimming pool and there is no swimming bag, the user may be informed of such a situation. The display 30 may be configured to display the location of the article inquired by the user as an icon.

Figure 2:
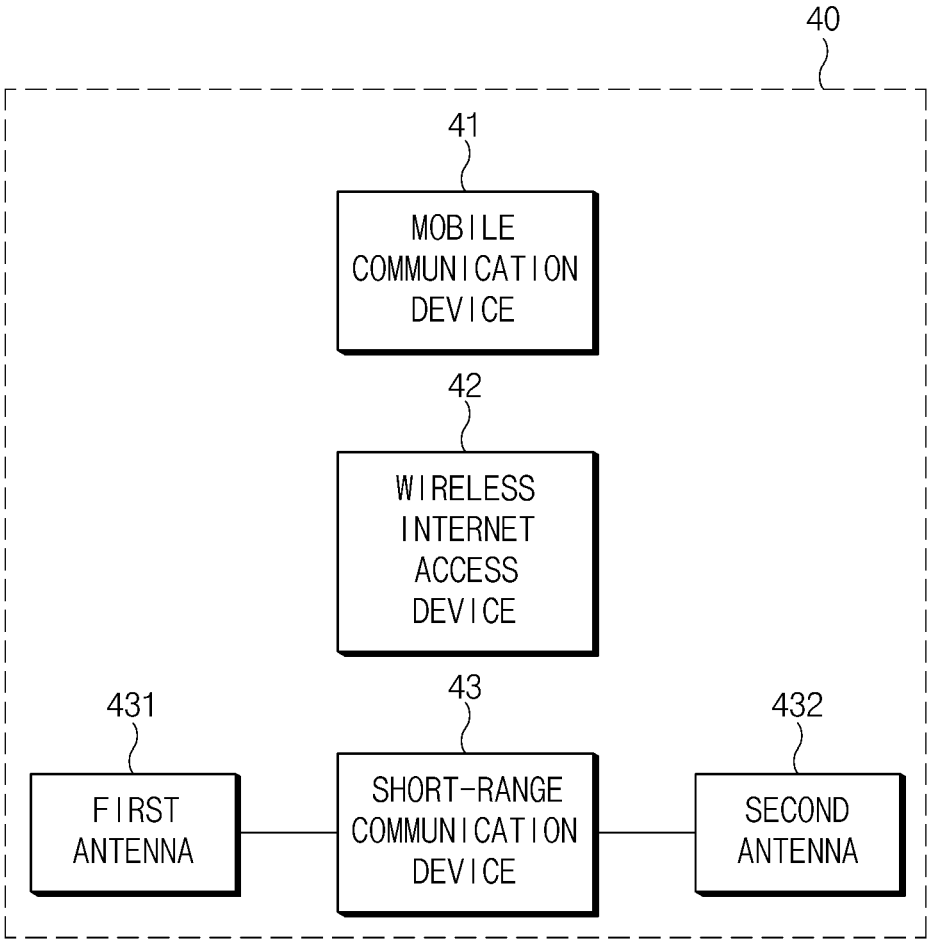
FIG. 2 is a block diagram illustrating a detailed configuration of a communicator provided in an apparatus for managing an article for a vehicle according to an exemplary embodiment of the present disclosure.

As shown in FIG. 2, the communicator 40 may include a mobile communication device 41 and a wireless Internet access device 42 configured to communicate with a portable terminal 200 of a user, and a short-range communication device 43 configured to communicate with the ID tag 300. FIG. 2 is a block diagram illustrating a detailed configuration of a communicator provided in an apparatus for managing an article for a vehicle according to an exemplary embodiment of the present disclosure.

As shown in FIG. 2, the mobile communication device 41 may be configured to transmit and receive data via a mobile communication network constructed according to a technical standard or communication scheme for mobile communication (e.g., global system for mobile communication (GSM), code division multi access (CDMA), code division multi access 2000 (CDMA2000), enhanced voice-data optimized or enhanced voice-data only (EV-DO), wideband CDMA (WCDMA), high speed downlink packet access (HSDPA), high speed uplink packet access (HSUPA), long term evolution (LTE), long term evolution-advanced (LTEA), and the like).

The wireless Internet access device 42 may be configured to transmit and receive data via wireless LAN (WLAN), wireless-fidelity (Wi-Fi), Wi-Fi direct, digital living network alliance (DLNA), wireless broadband (WiBro), world interoperability for microwave access (WiMAX), high speed downlink packet access (HSDPA), high speed uplink packet access (HSUPA), long term evolution (LTE), long term evolution-advanced (LTE-A), and the like. The short-range communication device 43 may support short-range communication by using at least one of Bluetooth™, radio frequency identification (RFID), infrared data association (IrDA), ultra-wideband (UWB), ZigBee, near field communication (NFC), and wireless USB technology.

The short-range communication device 43 may include a first antenna 431 and a second antenna 432, and the controller 50 may use the first and second antennas 431 and 432 to identify the location of the ID tag 300 in the vehicle. The controller 50 may be configured to execute the overall operation for each component to perform a function corresponding thereto. The controller 50 may be implemented in the form of hardware or software, or may be implemented in a combination of hardware and software. The controller 50 may be implemented as a microprocessor, but is not limited thereto.

Specifically, the controller 50 may be configured to receive a request to register various articles (e.g., personal articles, office supplies, sports goods, leisure goods, and the like) to which the ID tag 300 is attached from the user, and perform various controls in the process of informing a user whether an article corresponding to a user situation is mounted on the vehicle (e.g., output a notification regarding the article). In particular, the controller 50 may be configured to generate an article registration table as shown in Table 1 based on various information input from the user through the input device 20. A user may place each article to which the ID tag 300 is attached to a reference location in the vehicle, and the controller 50 may be configured to obtain the receiving strength of each article obtained through the communicator 40. In particular, the controller 50 may be configured to set the average of the receiving strength at the first antenna 431 and the receiving strength at the second antenna 432 for the ID tag 300 as the receiving strength of the ID tag 300.

The controller 50 may be configured to monitor whether the article registered in the article registration table is mounted on a vehicle and record the result in the mounted-or-not field of the article registration table. The controller 50 may be configured to generate an article management table in which article information for each category set by a user is recorded through the input device 20. In particular, the articles for each category must be registered in the article registration table in advance, and one article may be registered in a plurality of categories.

The controller 50 may be configured to output a notification to a user whether an article corresponding to a user situation is mounted on a vehicle. In other words, the controller 50 may be configured to determine whether articles corresponding to a destination set in a vehicle navigation system are mounted based on the article management table stored in the storage 10, and in response to determining that there an article is not mounted on the vehicle, the controller 50 may be configured to operate the display 30 to output a notification to the user regarding the article status. Particularly, the controller 50 may be configured to determine whether the articles corresponding to a destination are mounted on the vehicle through the communicator 40.

When the time set in the article management table stored in the storage 10 arrives, the controller 50 may be configured to determine whether articles corresponding to the time are mounted on the vehicle, and in response to determining that there an article if not mounted on the vehicle, the controller 50 may be configured to operate the display 30 to output a notification to the user regarding the article status. When the controller 50 receives a request for the location of the article from the user through the input device 20, the controller 50 may be configured to determine the location of the article in the vehicle using the short-range communication device 43 of the communicator 40.

The controller 50 may be configured to operate the display 30 to inform the user of the location of an article in the vehicle, or provide the location information of the article in the vehicle to the portable terminal 200 of a user via the mobile communication device 41 or the wireless Internet access device 42 of the communicator 40. In particular, the location information of an article in the vehicle may be displayed on an image as shown in FIG. 3 for convenience of the user.

Hereinafter, an operation of determining a location of an article in a vehicle by the controller 50 will be described in detail with reference to FIG. 3. FIG. 3 is a view illustrating an operation in which a controller provided in an apparatus for managing an article for a vehicle according to an exemplary embodiment of the present disclosure determines a location of an article in the vehicle.

Figure 3:
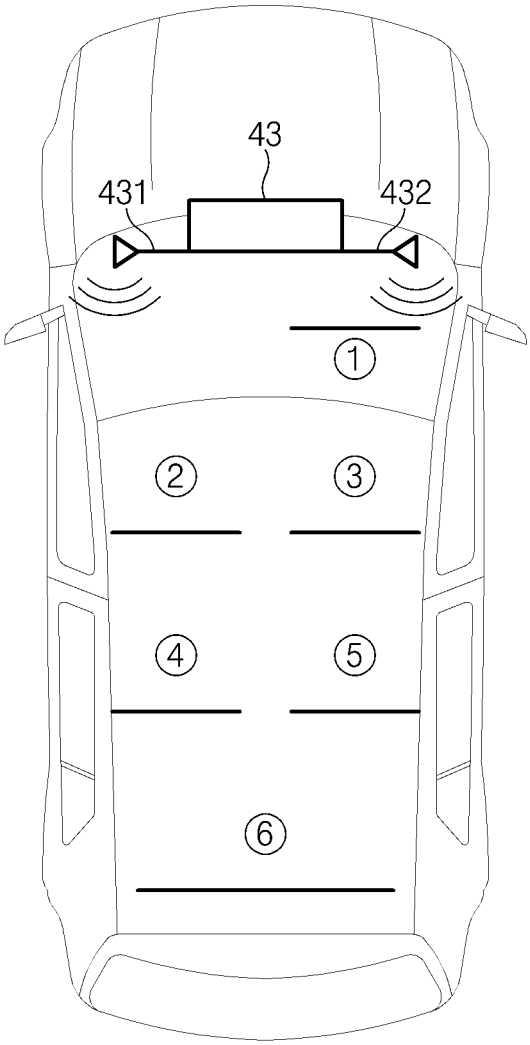
FIG. 3 is a view illustrating an operation in which a controller provided in an apparatus for managing an article for a vehicle according to an exemplary embodiment of the present disclosure grasps a location of an article in the vehicle.

As shown in FIG. 3, the inner space of a vehicle may be divided into a glove box ①, a driver seat space ②, a passenger seat space ③, a left rear seat space ④, a right rear seat space ⑤, and a trunk ⑥. The storage 10 may further store an article location table as shown in following Table 3.

TABLE 3

| Classification | | ③ | ② | ③ | ⑥ | ⑥ | ⑥ |
|---|---|---|---|---|---|---|---|
| Location | | Glove box | Driver seat space | Passenger seat space | Left rear seat space | Right rear seat space | Trunk |
| Receiving strength | | −35 dBm | −54 dBm | −54 dBm | −64 dBm | −64 dBm | −75 dBm |
| Response time | First antenna | 0.012 ms | 0.015 ms | 0.017 ms | 0.020 ms | 0.023 ms | 0.030 ms |
| | Second antenna | 0.010 md | 0.017 ms | 0.015 ms | 0.023 ms | 0.020 ms | 0.030 ms |

In Table 3, the receiving strength represents the average value of the receiving strength of the first antenna 431 and the receiving strength of the second antenna 432. For example, when an article to which the ID tag 300 is attached located in the glove box ①, the response time when the first antenna 431 communicates with the ID tag 300 and the response time when the second antenna 432 communicates with the ID tag 300 are represented, respectively.

The controller 50 may be configured to determine the location of an article in the vehicle based on the article location table stored in the storage 10. The controller 50 may be configured to determine that the article in the vehicle is stolen when an article in the vehicle is out of or beyond the communication area of the communicator 40 while the vehicle is parked and may be configured to inform the user of the movement of the article to the portable terminal 200 of the user. The controller 50 may be configured to separately manage the fixed article (e.g., a gas cylinder, an oil cylinder, a fire extinguisher, a Kimchi box, and the like) of which the location in the vehicle should not be changed, and when the location of the fixed article in the vehicle changes, may be configured to operate the display 30 to output a notification to a user regarding the location change of the article.

In response to determining that a previously registered article is mounted on the vehicle, the controller 50 may be configured to operate the display 30 to output a message that provides a guidance to the setting of a destination that corresponds to the use of the article. For example, in response to determining that a swimming bag is mounted on the vehicle, message "Do you want to set the destination as a swimming pool?" may be output. The controller 50 may be configured to set a destination in conjunction with a navigation device provided in the vehicle. When the controller 50 receives a request for the status of the articles in the vehicle from the portable terminal 200 of the user, the controller 50 may be configured to determine the articles in the vehicle and provide the result to the portable terminal 200 of the user.

The controller 50 may be configured to edit the article registration table, the article management table, and the article location table in response to a request from the portable terminal 200 of the user. When the controller 50 receives a request for setting the vehicle's destination from the portable terminal 200 of the user, the controller 50 may be configured to determine whether an article corresponding to the destination is mounted on the vehicle, and provide the determination information to the portable terminal 200 of the user. An apparatus for managing an article for a vehicle according to an exemplary embodiment of the present disclosure may be implemented in the form of a vehicle terminal, wherein the vehicle terminal may include a head unit.

Figure 4:
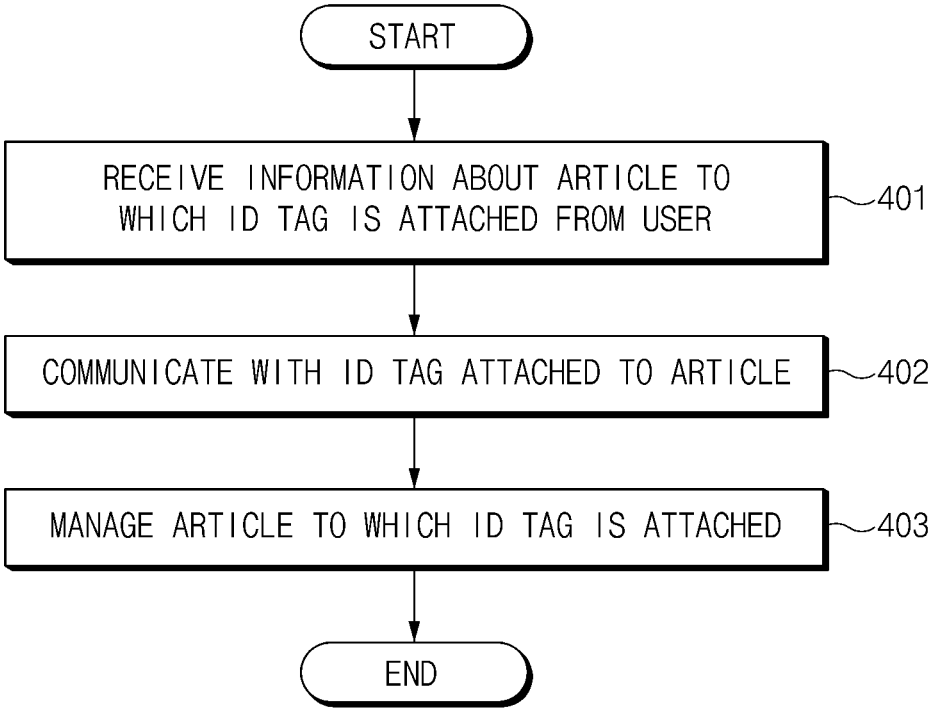
FIG. 4 is a flowchart illustrating a method of managing an article for a vehicle according to an exemplary embodiment of the present disclosure.

FIG. 4 is a flowchart illustrating a method of managing an article for a vehicle according to an exemplary embodiment of the present disclosure. First, in operation 401, the input device 20 be configured to receive information regarding an article to which an ID tag is attached from a user. Thereafter, in operation 402, the communicator 40 may be configured to communicate with the ID tag attached to the article.

Then, in operation 403, the controller 50 be configured to manage the article to which the ID tag is attached based on the communication result of the communicator 40. In other words, the controller 50 may be configured to provide notification indicating whether an article corresponding to a user situation is mounted on the vehicle. For example, when a destination is set in the vehicle navigation device, the controller 50 may be configured to determine whether the articles corresponding to the destination are mounted on the vehicle, and provide the user with information regarding any articles not mounted on the vehicle.

According to an apparatus for managing an article for a vehicle and a method thereof of the present disclosure, various articles (e.g, personal articles, office supplies, sports goods, leisure goods, and the like) to which an ID tag is attached and which are provided from a user may be registered, and the user may be informed whether an article corresponding to a user situation is mounted on the vehicle, thereby maximizing user convenience for various activities associated with a vehicle.

The above description is a simple exemplification of the technical spirit of the present disclosure, and the present disclosure may be variously corrected and modified by those skilled in the art to which the present disclosure pertains without departing from the essential features of the present disclosure. Therefore, the disclosed exemplary embodiments of the present disclosure do not limit the technical spirit of the present disclosure but are illustrative, and the scope of the technical spirit of the present disclosure is not limited by the exemplary embodiments of the present disclosure. The scope of the present disclosure should be construed by the claims, and it will be understood that all the technical spirits within the equivalent range fall within the scope of the present disclosure.

What is claimed is:

1. An apparatus for managing an article for a vehicle, comprising:

an input device configured to receive information regarding the article to which an identification (ID) tag is attached from a user;

a communicator configured to communicate with the ID tag attached to the article; and a controller configured to manage the article to which the ID tag is attached, wherein the controller is configured to output a notification to a user indicating whether an article corresponding to a user situation is mounted on the vehicle, wherein the controller is configured to determine a location of the article in the vehicle and provide the notification to the user of the identified location in the vehicle in response to receiving a request for the location of the article in the vehicle from the user via the input device.

2. The apparatus of claim 1, wherein the controller is configured to generate an article registration table in which at least one of an ID of the article, an article name, a receiving strength of the article measured at a reference location in the vehicle, and whether the article is mounted in the vehicle is stored.

3. The apparatus of claim 2, wherein the controller is configured to monitor whether each article is mounted on the vehicle via the communicator to update the article registration table.

4. The apparatus of claim 1, wherein the controller is configured to generate an article management table in which the article to which the ID tag is attached and which is registered by the user is classified into a category.

5. The apparatus of claim 4, wherein the category includes a destination of the vehicle and time.

6. The apparatus of claim 1, wherein the controller is configured to determine whether articles corresponding to a destination of the vehicle are mounted on the vehicle and output the notification to the user indicating that an article is not mounted on the vehicle when the destination of the vehicle is set.

7. The apparatus of claim 1, wherein the controller is configured to determine a location of the article in the vehicle and provide a notification to a portable terminal of the user of the identified location in the vehicle in response to receiving a request for the location of the article in the vehicle from the portable terminal of the user.

8. The apparatus of claim 1, wherein the controller is configured to determine that the article is stolen and provide a notification to a portable terminal of the user of article theft in response to determining that a location of the article in the vehicle is changed while the vehicle is parked.

9. The apparatus of claim 1, wherein the controller is configured to separately manage a fixed article of which a location in the vehicle is prohibited from being changed and provide a notification to the user of a location change of the fixed article in response to determining that the location of the fixed article in the vehicle is changed.

10. The apparatus of claim 1, wherein the controller is configured to provide a guidance to set up a destination corresponding to a purpose of a previously registered article in response to determining that the previously registered article is mounted on the vehicle.

11. The apparatus of claim 1, wherein the controller is configured to determine whether an article corresponding to a destination is mounted on the vehicle and provide information regarding a determination result to a portable terminal of the user in response to receiving a setting of a vehicle destination from the portable terminal of the user.

12. The apparatus of claim 1, wherein the article includes at least one of personal articles, office supplies, sports goods, and leisure articles.

13. A method of managing an article for a vehicle, comprising:

receiving, by an input device, information regarding an article to which an identification (ID) tag is attached from a user;

communicating, by a communicator, with the ID tag attached to the article; and managing, by a controller, the article to which the ID tag is attached, wherein the managing of the article includes providing a notification to the user regarding whether an article corresponding to a user situation is mounted on the vehicle, and wherein the managing of the article to which the ID tag is attached further includes:

determining a location of the article in the vehicle when a request for the location of the article in the vehicle is received from a portable terminal of the user, and providing a notification to the portable terminal of the user regarding the determined location in the vehicle.

14. The method of claim 13, wherein the providing of a notification indicating whether the article is mounted on the vehicle includes:

determining whether articles corresponding to a destination of the vehicle are mounted on the vehicle; and providing the notification to the user indicating that an article is not mounted on the vehicle.

15. The method of claim 13, wherein the managing of the article to which the ID tag is attached further includes:

determining a location change of the article in the vehicle while the vehicle is parked; and determining that the article is stolen and providing a notification to a portable terminal of the user regarding article theft.

16. The method of claim 13, wherein the managing of the article to which the ID tag is attached further includes:

separately managing a fixed article of which a location in the vehicle is prohibited from being changed; and providing a notification to the user of a location change of the fixed article in response to determining that the location of the fixed article in the vehicle is changed.

17. The method of claim 13, wherein the providing of notification indicating whether the article is mounted on the vehicle includes:

receiving a setting of a vehicle destination from a portable terminal of the user;

determining whether an article corresponding to the destination is mounted on the vehicle; and providing determined information to the portable terminal of the user.

18. The method of claim 13, wherein the article includes at least one of personal articles, office supplies, sports goods, and leisure articles.

* * * * *